United States Patent [19]

Rathbun

[11] Patent Number: 4,615,326

[45] Date of Patent: Oct. 7, 1986

[54] ARCHERY BOW ATTACHMENT

[76] Inventor: Clifford D. Rathbun, 113 Greenshield, Lake Orion, Mich. 48035

[21] Appl. No.: 590,904

[22] Filed: Mar. 19, 1984

[51] Int. Cl.[4] ..... F41B 5/00

[52] U.S. Cl. ..... 124/88; 124/90

[58] Field of Search ..... 124/23 R, 24 R, 41 A, 124/86, 88

[56] References Cited

U.S. PATENT DOCUMENTS

| | | | |
|---|---|---|---|
| 1,210,332 | 12/1916 | Kvistad | 124/41 R |
| 2,664,078 | 12/1953 | Irwin | 124/24 R |
| 3,244,161 | 5/1964 | Jenson | 124/41 A |
| 3,512,512 | 5/1970 | Wentz | 124/24 R |
| 3,557,769 | 1/1971 | Hofmeister | 124/24 R |
| 3,561,418 | 2/1971 | Fredrickson | 124/24 R |
| 3,794,012 | 2/1974 | Ramsey | 124/24 R |
| 4,061,125 | 12/1977 | Trotter | 124/24 R |
| 4,066,051 | 1/1978 | Alban | 124/86 |
| 4,146,009 | 3/1979 | Adams | 124/88 |

*Primary Examiner*—William H. Grieb
*Assistant Examiner*—Benjamin Layno
*Attorney, Agent, or Firm*—Gifford, Groh, VanOphem, Sheridan, Sprinkle & Dolgorukov

[57] ABSTRACT

The present invention provides an attachment for an archery bow which allows a bow string to be pre-cocked prior to use. The attachment comprises a plate attached to a midpoint on the bow and an elongated rod having one end adapted to engage the bow string and its outer end pivotally secured to the plate. The rod is pivotal between a first position in which the rod extends outwardly from the bow and engages the midpoint of the bow string to maintain the bow string in a partially drawn pre-cocked position. When the bow string is moved to its fully cocked position, the rod under the force of gravity pivots downwardly to its second position and out of the way of the bow string to permit the normal operation of the bow.

8 Claims, 3 Drawing Figures

ARCHERY BOW ATTACHMENT

BACKGROUND OF THE INVENTION

I. Field of the Invention

The present invention generally relates to attachments for archery bows and, more particularly, to a pre-cocking attachment for an archery bow.

II. Description of the Prior Art

Archery bows, by their very nature, are physically difficult to cock, aim and fire due to the large tension of the bow string. When hunting for game, it is a frequent occurrence that between the time the hunter sights the game and properly cocks and aims the bow, the game has disappeared.

There are a number of previously known cross bows which overcome the above mentioned disadvantage of archery bows. Such cross bows maintain the bow string in its fully cocked position and releases the bow string with its arrow upon the simple depression of a trigger. It is unlawful, however, to hunt game with cross bows in many parts of the country.

SUMMARY OF THE PRESENT INVENTION

The present invention provides a pre-cocking attachment for an archery bow which overcomes the above mentioned disadvantages of archery bows and yet is lawful in use.

In brief, the attachment of the present invention comprises a plate which is secured to a midpoint of the bow. An elongated rod has one end adapted to engage the bow string while its other end is pivotally secured to the plate. The rod is pivotal between a first position in which the rod extends generally perpendicularly outwardly from the plate to maintain the bow string in a partially drawn pre-cocked position. In its second position, the rod depends downwardly from the plate adjacent the bow and thus does not interfere with the operation of the archery bow.

In use, the bow string is moved to a partially drawn pre-cocked position, which is less than a fully cocked position, for the bow. At that time, the rod is pivoted to its first position and the bow string positioned across the first end of the rod. Upon release of the bow string, the bow string maintains the rod in its first pivotal position and, simultaneously, the rod maintains the bow string in its partially drawn pre-cocked position.

Thereafter, when the bow string is moved to its fully cocked position, the rod, by weight, pivots downwardly to its second position and thus out of the way of the bow string. The archery bow can then be fired in the normal fashion.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
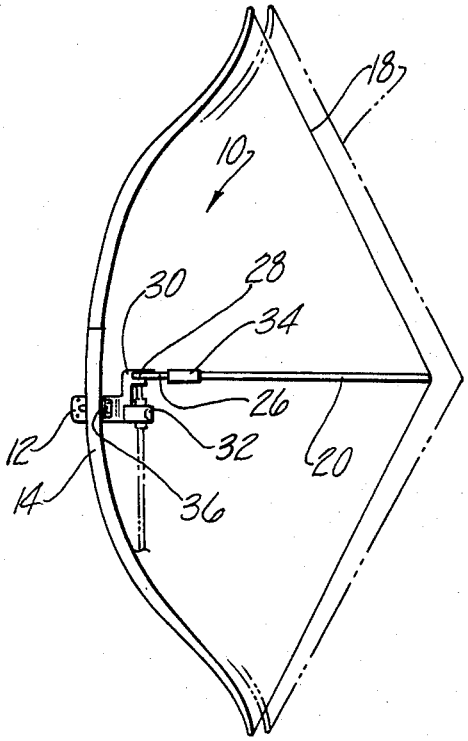
FIG. 1 is a side view illustrating a preferred embodiment of the present invention, secured to an archery bow.
Figure 3:
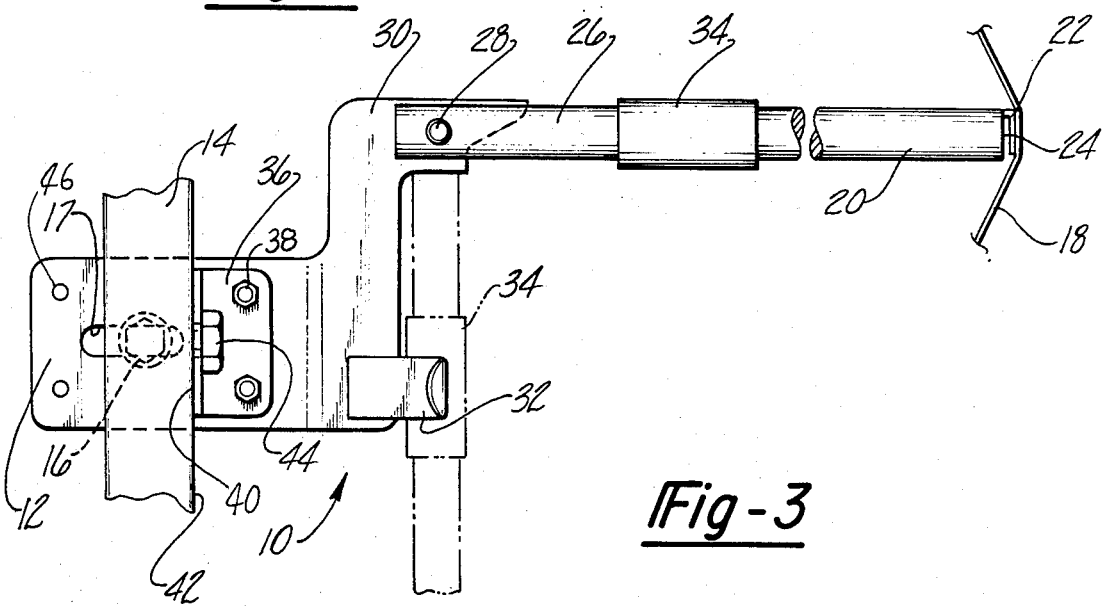
FIG. 3 is a fragmentary side view, similar to FIG. 1, though with parts removed and enlarged for clarity.

With reference first to FIGS. 1 and 3, a preferred embodiment of the attachment 10 of the present invention is thereshown and comprises a plate 12 which is secured to the side and at a midpoint of an archery bow 14. Any conventional means, such as a screw 16 extending through a slot 17, can be used to secure the plate 12 to the archery bow 14. The archery bow includes a bow string 18 which can be moved from a partially drawn pre-cocked position, shown in solid line in FIG. 1, to a fully cocked position, shown in phantom line in FIG. 1.

With reference still to FIGS. 1 and 3, the attachment 10 comprises an elongated rod 20 having a groove 22 formed in one end 24. This groove 22 is adapted to engage and retain the bow string 18 when in its partially drawn pre-cocked position. The other end 26 of the rod 20 is pivotally secured by a pivot pin 28 to the plate 12.

The rod 20 is thus pivotally connected to the plate 12 to pivot between a first position, illustrated in solid line in FIGS. 1 and 3, and a second position illustrated in phantom lines in FIGS. 1 and 3. In its first position, the rod 20 extends laterally outwardly from the bow 14 and towards the bow string 18. Conversely, in its second position, the rod 20 depends downwardly from the plate 12 adjacent the bow 14 and thus out of the way of the normal operation of the bow string 18. Furthermore, the rod 20 is dimensioned so that, with the rod 20 in its first position, the rod 20 maintains the bow string 18 in its partially drawn pre-cocked position.

Figure 2:
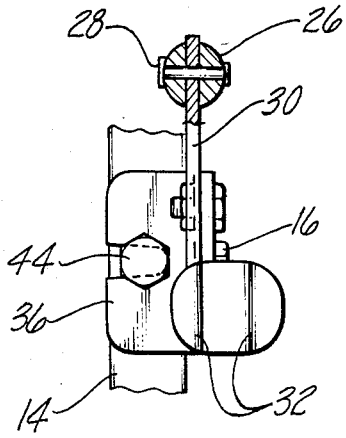
FIG. 2 is a partially sectional end view, similar to that seen by a user.

With reference now particularly to FIGS. 2 and 3, an abutment stop 30 on the plate 12 limits the upward extension of the rod 20 to its first position. Similarly, a pair of spring clips 32 limit the pivotal action of the rod 20 to its second position so that the total pivotal swing of the rod 20 is substantially 90 degrees. The spring clips 32 further engage an enlarged diameter cushion 34 secured to the rod 20.

The spring clips 32 perform two important functions. First, if desired, the cushion 34 can be pushed in between the spring clips 32 whereupon the spring clips 32 retain the rod 20 in its second or downwardly depending position. The bow 14 can then be used in its normal fashion. Secondly, the spring clips 32 together with the cushion 34 serve to cushion the impact and muffle the noise of the rod 20 as it swings from its first and towards its second position.

With reference now particularly to FIG. 3, an L-shaped torque plate 36 is preferably secured to one side of the plate 12 by bolts 38 so that one leg 40 of the plate 36 abuts against the rear 42 of the bow 14 to prevent any twisting of the plate 12 with respect to the bow 14. Preferably, the leg 40 is secured to the bow 14 by a bolt 44. Alternatively, the torque plate 36 is secured to holes 46 at the front of the plate 12 so that the leg 40 abuts against the front of the bow 14.

In operation, the bow string 18 is first moved to its partially drawn pre-cocked position as shown in solid line in FIG. 1 and the rod 20 is simultaneously moved to its first position. The bow string 18 is then positioned within the rod groove 22 which prevents the bow string 18 from slipping off from the end 24 of the rod 20. Simultaneously, the tension of the bow string 18 maintains the rod 20 in its first position.

With the rod 20 in its first position, the attachment 10 of the present invention maintains the archery bow 14 in its partially drawn pre-cocked position for any desired period of time. When it is desired to fire an arrow, the archer moves the bow string 18 rearwardly to its fully cocked position, shown in phantom line in FIG. 1, which releases the rod 20 from its first position. The rod 20 then swings or pivots downwardly by gravity to its second position, out of the way of the bow string 18, and allows the bow to be fired in its intended fashion.

From the foregoing, it can be seen that the present invention provides a pre-cocking attachment for an archery bow which not only facilitates hunting but also is lawful to use. Having described my invention, however, many modifications thereto will become apparent to those skilled in the art to which it pertains without deviation from the spirit of the invention as defined by the scope of the appended claims.

I claim:

1. A pre-cocking attachment for an elongated archery bow having a bow string on one side, said attachment comprising:

a plate, means for removably securing said plate to a midpoint of one side of the bow whereby said attachment may be removably secured to a conventional archery bow, an elongated rod having one end adapted to engage the bow string, means for pivotally mounting the other end of said rod to said plate so that said rod is pivotal between a first position in which said rod extends outwardly from the bow towards the bow string and engages the bow string to move the bow string to a partially drawn pre-cocked position and a second position in which said rod depends downwardly from said plate adjacent the bow, and disengages from the bow string, wherein said rod has a length greater than the distance between said bow midpoint and a midpoint of the bow string when the bow is uncocked, wherein with said rod in said first position and with said rod engaging said bow string, said rod maintains the bow string in a partially drawn pre-cocked position, and wherein said rod pivots by gravity to said second disengaged position when the bow string is drawn rearwardly from said partially drawn pre-cocked position to a fully cocked position.

2. The invention as defined in claim 1 and comprising a torque plate secured to said plate, said torque plate comprising a leg which abuts against a further side of said bow.

3. The invention as defined in claim 1 wherein said rod pivots substantially ninety degrees between said first and said second position.

4. The invention as defined in claim 3 and comprising means for limiting the pivotal movement of said rod between said first and said second position.

5. A pre-cocking attachment for an elongated archery bow having a bow string on one side, said attachment comprising:

a plate, means for securing said plate to a midpoint of one side of the bow, an elongated rod having one end adapted to engage the bow string, means for pivotally mounting the other end of said rod to said plate so that said rod is pivotal between a first position in which said rod extends outwardly from the bow towards the bow string and a second position in which said rod depends downwardly from said plate adjacent the bow, and disengages from the bow string, wherein said rod has a length greater than the distance between said bow midpoint and a midpoint of the bow string when the bow is uncocked, wherein with said rod in said first position and with said rod end engaging said bow string, said rod maintains the bow string in a partially drawn pre-cocked position, and wherein said rod pivots by gravity to said second disengages position when the bow string is moved to a fully cocked position, and means for cushioning the impact of said rod as said rod moves to said second position.

6. The invention as defined in claim 5 wherein said cushioning means comprises a cushion on said rod and a pair of spring clips secured to said plate which engage said cushion when said rod is in said second position.

7. The invention as defined in claim 6 wherein said spring clips releasably retain said rod in said second position.

8. A pre-cocking attachment for an elongated archery bow having a bow string on one side, said attachment comprising:

a plate;

means for securing said plate to a midpoint of one side of the bow;

an elongated rod having one end adapted to engage the bow string;

means for pivotally mounting the other end of said rod to said plate so that said rod is pivotal between a first position in which said rod extends outwardly from the bow towards the bow string and a second position in which said rod depends downwardly from said plate adjacent the bow and disengages from the bow string;

wherein said rod has a length greater than the distance between said bow midpoint and a midpoint of the bow string when the bow is uncocked;

wherein with said rod in said first position and with said rod end engaging said bow string, said rod maintains the bow string in a partially drawn pre-cocked position;

wherein said rod pivots by gravity to said second disengaged position when the bow string is moved to a fully cocked position; and means for cushioning the impact of said rod as said rod pivots to said second position, said means comprising a cushion on said rod and a pair of spring clips secured to said plate which engage said cushion and releasably retain said rod in said second position.

* * * * *

UNITED STATES PATENT AND TRADEMARK OFFICE

CERTIFICATE OF CORRECTION

PATENT NO. : 4,615,326
DATED : October 7, 1986
INVENTOR(S) : Clifford D. Rathbun It is certified that error appears in the above-identified patent and that said Letters Patent are hereby corrected as shown below:

Column 4, line 20, delete "disengages" and insert --disengaging--.

Signed and Sealed this

Twenty-fourth Day of February, 1987

*Attest:*

DONALD J. QUIGG

*Attesting Officer* *Commissioner of Patents and Trademarks*